US010014085B2

(12) United States Patent
Grenier

(10) Patent No.: US 10,014,085 B2
(45) Date of Patent: Jul. 3, 2018

(54) REUSEABLE HOLDER FOR A RADIOACTIVE SOURCE CAPSULE

(71) Applicant: ILLINOIS TOOL WORKS INC., Glenview, IL (US)

(72) Inventor: Steven J. Grenier, Arlington, MA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/514,549

(22) PCT Filed: Aug. 28, 2015

(86) PCT No.: PCT/US2015/047338

§ 371 (c)(1),
(2) Date: Mar. 27, 2017

(87) PCT Pub. No.: WO2016/053525

PCT Pub. Date: Apr. 7, 2016

(65) Prior Publication Data

US 2017/0229200 A1 Aug. 10, 2017

Related U.S. Application Data

(60) Provisional application No. 62/059,484, filed on Oct. 3, 2014.

(51) Int. Cl.
*G21F 5/12* (2006.01)
*G21F 5/015* (2006.01)

(52) U.S. Cl.
CPC ..... *G21F 5/015* (2013.01); *G21F 5/12* (2013.01)

(58) Field of Classification Search
CPC ..... G21F 5/015; G21F 5/12
USPC ..... 250/506.1, 505.1
See application file for complete search history.

(56) References Cited

U.S. PATENT DOCUMENTS

| | | | |
|---|---|---|---|
| 2007/0295332 | A1 | 12/2007 | Ziegler et al. |
| 2009/0308390 | A1 | 12/2009 | Smutney et al. |
| 2014/0198485 | A1 | 7/2014 | Karchon et al. |
| 2015/0121941 | A1 | 5/2015 | Tiran et al. |

FOREIGN PATENT DOCUMENTS

| | | | |
|---|---|---|---|
| DE | 1240598 | B | 5/1967 |
| EP | 2664881 | A1 | 11/2013 |
| FR | 1218610 | A | 5/1960 |

OTHER PUBLICATIONS

ISR & WO for PCT/US2015/047338 dated Dec. 9, 2015.

*Primary Examiner* — Nicole Ippolito
*Assistant Examiner* — Hanway Chang
(74) *Attorney, Agent, or Firm* — McCarter & English, LLP

(57) ABSTRACT

This disclosure pertains to a holder for a radioactive source capsule with pivoting first and second parts, with redundant mechanisms for retention of the capsule during transportation and handling. These retaining mechanisms include a set screw in the first pivoting part to engage the capsule and to prevent radial movement of the capsule, a locking shelf in the second pivoting part to fix the axial orientation of the pivoting bottom end of the capsule holder, and a capture tooth within the capsule to prevent release of the capsule while in the shipping and/or handling tube of the capsule holder.

16 Claims, 2 Drawing Sheets

REUSEABLE HOLDER FOR A RADIOACTIVE SOURCE CAPSULE

RELATED APPLICATIONS

This application is a national phase of International Application Number PCT/US2015/047338 filed Aug. 28, 2015 and claims priority of U.S. Provisional Application No. 62/059,484, filed on Oct. 3, 2014, the contents of which is hereby incorporated by reference in its entirety and for all purposes.

BACKGROUND OF THE DISCLOSURE

Field of the Disclosure

This disclosure pertains to a holder for a radioactive source capsule, with improved retention of the capsule during transportation and handling.

Description of the Prior Art

In the field of transportation and handling of radioactive capsules, the need for reliable retention and confinement of the capsules is well-established and self-evident.

Examples of prior art for a reusable shaft mounted radioactive capsule holder include the screw and pin design. This design also uses a top and bottom holder ends, but the bottom end threads into the top end and then the parts are pinned together radially. A typical deficiency of this design is the pin is required to be installed and removed for every use. This process degrades the retaining hole in the both the top and bottom holder ends. The pin could eventually fall out due to excessive wear allowing the threaded holder to unscrew during transport or handling.

Additionally, once the holder has arrived on site, the radial pin needs to be removed and then the bottom end of the holder unthreaded. Locating and removing the radial pin in a high radiation field frequently requires accurate and robust tooling. The pin and holder are frequently damaged in the pinning and de-pinning process.

A further prior art design is the screw and nut design. This design is similar to the screw and pin but uses a locking nut to lock the top and bottom ends together instead of using a radial pin. This design may unthread axially if the nut were to loosen and ultimately release the capsule while in the transport or handling tube.

Further improvements are sought in this art to retain the radioactive capsules more securely and more reliably.

OBJECTS AND SUMMARY OF THE DISCLOSURE

It is therefore an object of the present disclosure to provide improvements in the transportation and handling of radioactive capsule, particularly with respect to security and reliability.

This and other objects are attained by providing a capsule holder with redundant retaining mechanisms. These retaining mechanisms include a set screw to prevent radial movement of the capsule, a locking shelf to fix the axial orientation of the pivoting bottom end of the capsule holder, and a capture tooth within the capsule to prevent release of the capsule while in the shipping and/or handling tube of the capsule holder.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENT

Figure 1:
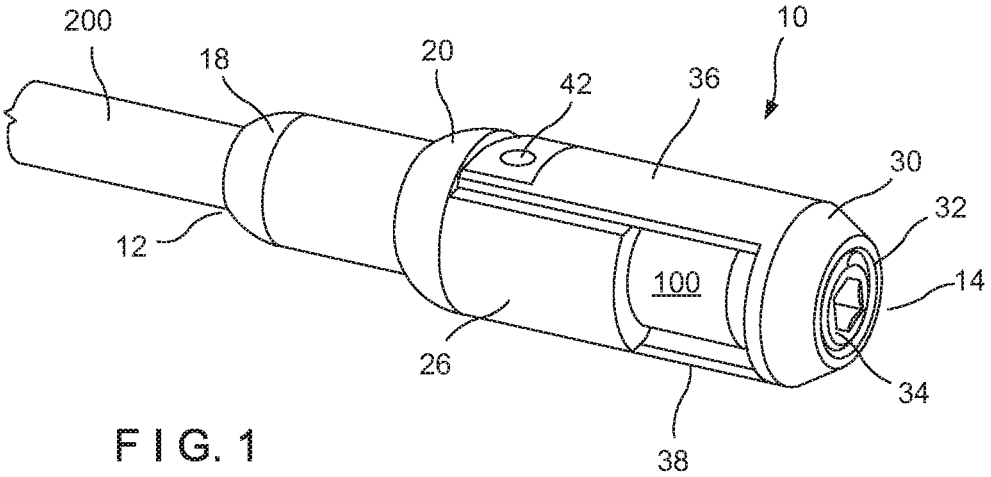
FIG. 1 is a perspective view of an embodiment of the holder of the present disclosure, shown in the closed configuration with a radioactive source capsule in a locked configuration.

Referring now to the drawings in detail, one sees the capsule holder 10 for a radioactive source capsule 100 in various views in FIGS. 1-5. The capsule holder 10 is generally cylindrical in shape with a top end (or proximal end) 12 and a bottom end (or distal end) 14. The top end 12 includes a cylindrical portion 18 which is configured to attach or affix to a shaft 200, which may be flexible or rigid, thereby allowing the capsule holder 10 to be driven by a remote device (not shown). Cylindrical portion 18 typically includes a blind aperture for receiving the shaft 200, but is not limited thereto. Those skilled in the art, after review of this disclosure, will recognize several methods or configurations for attaching or affixing the shaft 200 to the top end 12 of the capsule holder 10.

Top end 12 further includes a partially hemispherical portion 20 thereby presenting a flat transverse partially circular locking shelf 22 (see FIG. 2), as well as an oblique face 24 which is formed opposite around the periphery of the locking shelf 22 from a partially circular longitudinally extending wall which forms a capture tooth 26. As described herein, the junction of the locking shelf 22 and the capture tooth 26 forms a partial seat for radioactive source capsule 100.

Figure 2:
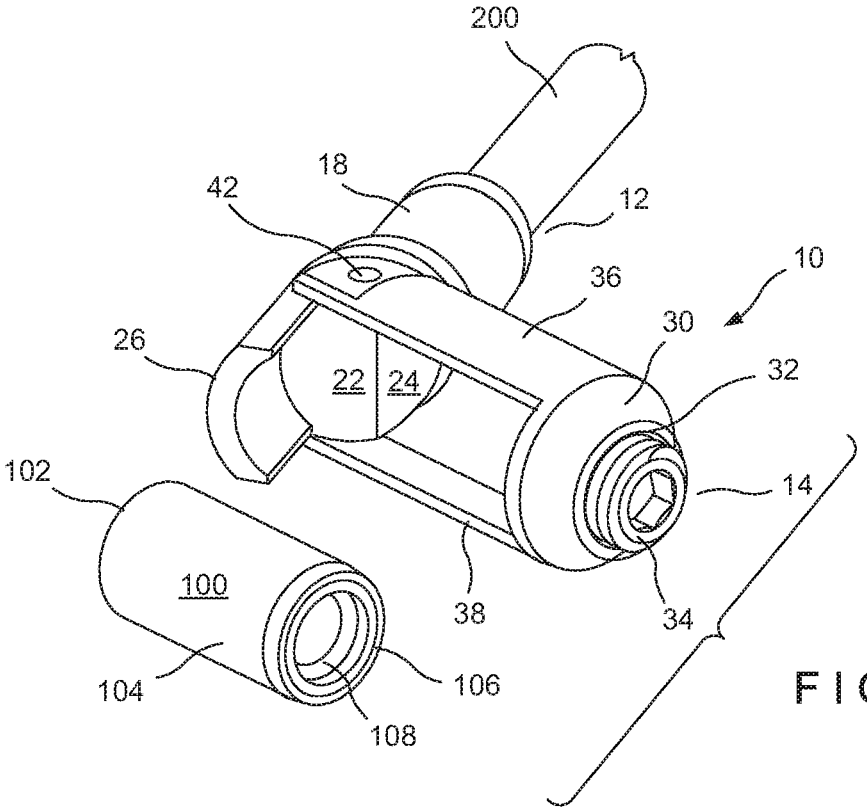
FIG. 2 is a perspective view of an embodiment of the holder of the present disclosure in an open configuration with the radioactive source capsule released.
Figure 3:
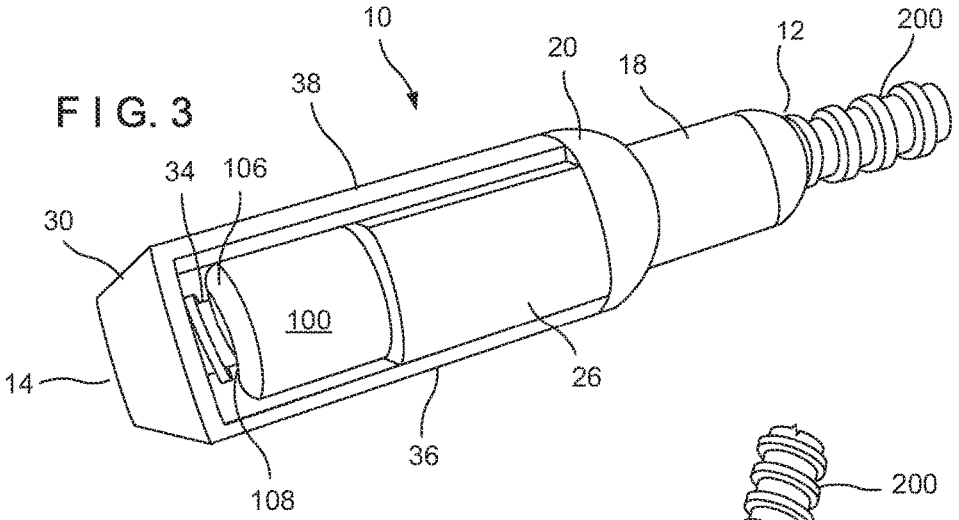
FIG. 3 is a further perspective view of an embodiment of the holder of the present disclosure in a closed and locked configuration.
Figure 4:
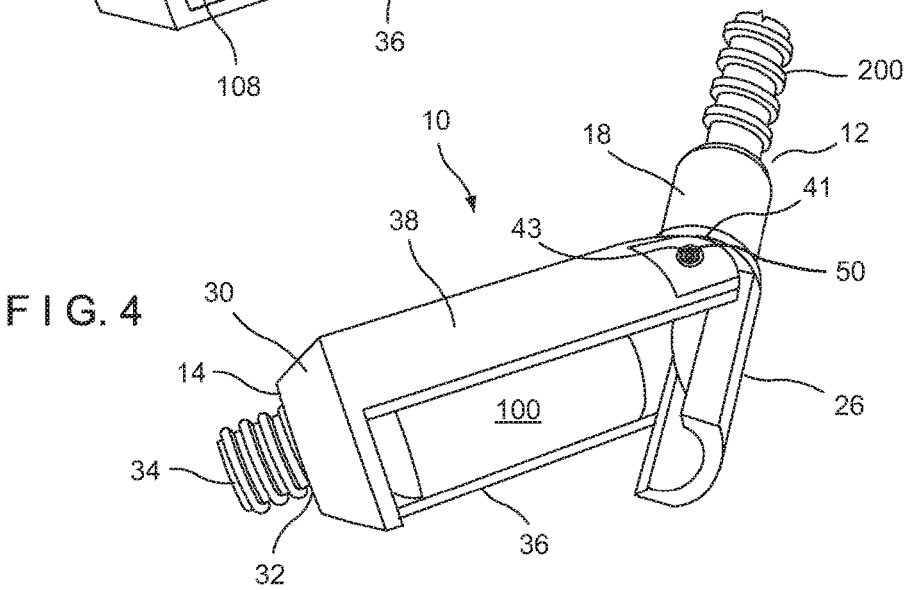
FIG. 4 is a perspective view of the holder of an embodiment of the present disclosure, shown in an open configuration with the radioactive source capsule ready to be removed.
Figure 5:
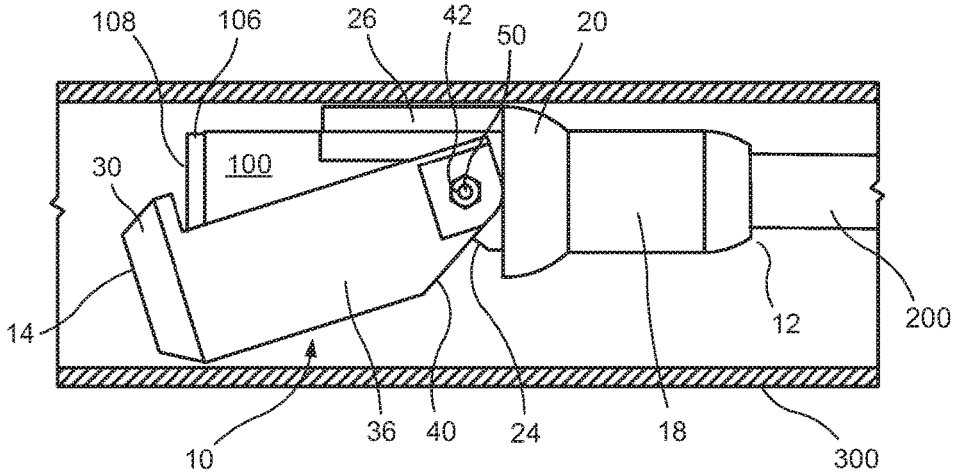
FIG. 5 is a plan view illustrating how the holder of the present disclosure prevents release of the radioactive source capsule while in a transport and handling tube or similar apparatus.

As shown in FIGS. 1 and 2, bottom end (or distal end) 14 includes a frusto-conical portion 30 forming an end cap through which a threaded aperture 32 is formed for threadably receiving a set screw 34 (shown in the inserted position in FIG. 1 and the partially withdrawn position in FIG. 2). Opposed partially cylindrical walls 36, 38 extend from frusto-conical portion 30. As best shown in FIG. 5, partially cylindrical wall 36 terminates in an oblique wall portion 40 and further includes a pivot aperture 42. Partially cylindrical wall 38 likewise terminates in an oblique wall portion 41 and a pivot aperture 43 as shown in FIG. 4. Pivot pin 50 passes from the pivot aperture 42 of partially cylindrical wall 36 to the pivot aperture 43 on partially cylindrical wall 38 through an unillustrated transverse pivot axis passageway which passes immediately beneath the locking shelf 22.

This pivot configuration allows the bottom end 14 to pivot between a closed and locked longitudinal configuration as shown in FIG. 1 and the open transverse or generally perpendicular configuration as shown in FIG. 2, with respect to the top end 12. As shown in FIG. 5, the oblique wall portion 40 allows the bottom end 14 to pivot more fully with respect to top end 12.

In order to install the radioactive source capsule 100 in the capsule holder 10, the user typically starts in the open configuration of FIG. 2 with the bottom end 14 pivoted away from a longitudinal alignment with top end 12 thereby resulting in the top and bottom ends 12, 14 being perpendicular to each other. The user inserts radioactive source capsule 100 between the first and second partially cylindrical walls 36, 38 with the recessed lid 108 of second end 106 of the radioactive source capsule 100 aligned with the set screw 34, as shown in FIG. 4. The user then pivots the bottom end 14 into the closed position of FIGS. 1 and 3 (i.e., the top and bottom ends 12, 14 being longitudinally aligned or the longitudinal axes of top and bottom ends 12, 14 aligning with each other). In this configuration, the first end 102 of the radioactive source capsule 100 abuts against the locking shelf 22 and the cylindrical side wall 104 of the radioactive source capsule 100 abuts against the capture tooth 26. In the configuration illustrated in FIGS. 1 and 3, the first and second partially cylindrical walls 36, 38 and the outer surface of capture tooth 26 form a partially cylindrical configuration. The user then uses an Allen wrench or similar tool to engage set screw 34 and drive set screw to engage the recessed lid 108 of second end 106 of radioactive source capsule 100 thereby achieving a locked configuration of FIGS. 1 and 3. These steps may be performed by a remote controlled gripping apparatus.

One sees that the illustrated embodiment of the reusable radioactive capsule holder 10 typically has the following characteristics:

The redundant retaining mechanisms prevent the cylindrically shaped radioactive capsule 100 from being unintentionally released during transport and handling. That is, the set screw 34 engages into the recessed lid 108 at the second end 108 of the capsule 100 (or similar workpiece) thereby preventing radial movement of the capsule 100 once engaged.

When the set screw 34 is installed into the holder 10 with the capsule 100 in place, the capsule 100 is pushed up against a locking shelf 22 at the top end 12 of the capsule holder 10 which fixes the axial orientation of the pivoting bottom end 14 with the top end 12 of the holder 10. This locking mechanism is intended to prevent the holder 10 from pivoting open.

The capture tooth 26 of the top end 12 of the capsule holder 10 is intended to prevent the release of the capsule 10 while in the shipping and/or handling tube 300 (see FIG. 5). The tube 300 is sized to restrict the pivoting angle between the top and bottom ends 12, 14, keeping the capsule 100 captured by the capture tooth 26.

The holder 10 is intended to present an easy method for releasing the radioactive source capsule 100 from the holder 10 after arriving on site for use. Since handling of the radioactive source capsule 100 is performed with a remote controlled gripping mechanism, the holder 100 typically needs only to be inserted into a rotating tool fitted with the proper Allen wrench to withdraw the set screw 34 and allow the holder 10 to pivot open thereby releasing the radioactive source capsule 100.

Thus the several aforementioned objects and advantages are most effectively attained. Although preferred embodiments of the invention have been disclosed and described in detail herein, it should be understood that this invention is in no sense limited thereby.

What is claimed is:

1. A device for retaining a workpiece, including;

a first retaining element;

a second retaining element which pivots with respect to the first retaining element from a first position to a second position;

the first retaining element including a transverse shelf element for abutting a first end of the workpiece and a wall element for abutting walls of the workpiece;

the second retaining element including an inwardly extending element for engaging a second end of the workpiece;

wherein in the first position, the first retaining element and the second retaining element are longitudinally aligned with each other;

wherein in the second position, the first and second retaining elements are perpendicular to each other;

wherein the wall element is a partially cylindrical wall for abutting cylindrical sidewalls of a cylindrical workpiece; and wherein the inwardly extending element includes a threaded screw received within a threaded aperture in the second retaining element.

2. The device of claim 1 wherein the threaded aperture is formed on an end of the second retaining element.

3. The device of claim 1 wherein the second retaining element includes a frusto-conical end cap on an end thereof, the threaded aperture passing through the end cap, and further including first and second legs extending from the end cap to a pivot axis on the first retaining element.

4. The device of claim 3 wherein the pivot axis includes a transverse passageway proximate to the transverse shelf element.

5. The device of claim 4 wherein the first retaining element includes a blind aperture for receiving a shaft.

6. The device of claim 1 wherein in the first position, the device is closed and retains the workpiece and in the second position, the device is open for receiving the workpiece.

7. A device for retaining a radioactive source capsule, including;

a first retaining element;

a second retaining element which pivots with respect to the first retaining element from a first position to a second position;

the first retaining element including a transverse shelf element for abutting a first end of the radioactive source capsule and a wall element for abutting walls of the radioactive source capsule; and the second retaining element including an inwardly extending element for engaging a second end of the radioactive source capsule.

8. The device of claim 7 wherein in the first position, the first retaining element and the second retaining element are longitudinally aligned with each other.

9. The device of claim 8 wherein in the second position, the first and second retaining elements are perpendicular to each other.

10. The device of claim 9 wherein the wall element is a partially cylindrical wall for abutting cylindrical sidewalls of a radioactive source capsule.

11. The device of claim 10 wherein the inwardly extending element includes a threaded screw received within a threaded aperture in the second retaining element.

12. The device of claim 11 wherein the threaded aperture is formed on an end of the second retaining element.

13. The device of claim 11 wherein the second retaining element includes a frusto-conical end cap on an end thereof, the threaded aperture passing through the end cap, and further including first and second legs extending from the end cap to a pivot axis on the first retaining element.

14. The device of claim 13 wherein the pivot axis includes a transverse passageway proximate to the transverse shelf element.

15. The device of claim 14 wherein the first retaining element includes a blind aperture for receiving a shaft.

16. The device of claim 9 wherein in the first position, the device is closed and retains the radioactive source capsule and in the second position, the device is open for receiving the radioactive source capsule.

* * * * *